US010777138B2

(12) United States Patent
Ji et al.

(10) Patent No.: US 10,777,138 B2
(45) **Date of Patent: *Sep. 15, 2020**

(54) PIXEL CIRCUITS AND DRIVING METHODS THEREOF, DISPLAY DEVICES

(71) Applicant: KunShan Go-Visionox Opto-Electronics Co., Ltd., Kunshan (CN)

(72) Inventors: Yanan Ji, Kunshan (CN); Wenzhi Fan, Kunshan (CN)

(73) Assignee: KunShan Go-Visionox Opto-Electronics Co., Ltd., Kunshan (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/441,526

(22) Filed: Jun. 14, 2019

(65) Prior Publication Data

US 2019/0295476 A1 Sep. 26, 2019

Related U.S. Application Data

(63) Continuation of application No. PCT/CN2018/092163, filed on Jun. 21, 2018.

(30) Foreign Application Priority Data

Oct. 31, 2017 (CN) ..... 2017 2 1426923 U

(51) Int. Cl.
*G09G 3/32* (2016.01)
*G09G 3/3233* (2016.01)

(52) U.S. Cl.
CPC ... *G09G 3/3233* (2013.01); *G09G 2300/0809* (2013.01); *G09G 2300/0814* (2013.01);
(Continued)

(58) Field of Classification Search
CPC ..... G09G 3/3233; G09G 2300/0814; G09G 2300/0819; G09G 2300/0809; G09G 2320/0223
See application file for complete search history.

(56) References Cited

U.S. PATENT DOCUMENTS

2016/0063922 A1* 3/2016 Tsai ..... G09G 3/3291 345/76
2016/0379571 A1* 12/2016 Kim ..... G09G 3/3233 345/215

FOREIGN PATENT DOCUMENTS

CN 104658482 A 5/2015
CN 104867442 A 8/2015
(Continued)

OTHER PUBLICATIONS

International Search Report dated Sep. 14, 2018 in corresponding International application No. PCT/CN2018/092163; 6 pages.

*Primary Examiner* — Liliana Cerullo
(74) *Attorney, Agent, or Firm* — Maier & Maier, PLLC

(57) ABSTRACT

Exemplary embodiments of the application disclose pixel circuits and driving methods thereof, display devices. A pixel circuit includes a first through seventh thin film transistors, a light-emitting diode, and a storage capacitance. The pixel circuit provided by exemplary embodiments of the application can compensate a power voltage during a light-emitting stage of the light-emitting diode, so that the current flowing through the LED is related to a data voltage and a reference voltage input into the pixel circuit, and is independent of the power voltage, thereby effectively avoiding the problem of the display unevenness of the display device, due to the difference in the current flowing into the LED caused by the power voltage drop.

14 Claims, 2 Drawing Sheets

(52) U.S. Cl.
CPC ..... *G09G 2300/0819* (2013.01); *G09G 2320/0223* (2013.01)

(56) References Cited

FOREIGN PATENT DOCUMENTS

| | | | |
|---|---|---|---|
| CN | 104992674 | A | 10/2015 |
| CN | 205004016 | U | 1/2016 |
| CN | 106097964 | A | 11/2016 |
| CN | 106297659 | A | 1/2017 |
| CN | 106373528 | A | 2/2017 |
| CN | 207352944 | U | 5/2018 |
| KR | 20140055535 | A | 5/2014 |

* cited by examiner

PIXEL CIRCUITS AND DRIVING METHODS THEREOF, DISPLAY DEVICES

CROSS-REFERENCE TO RELATED APPLICATIONS

This application is a continuation of International application No. PCT/CN2018/092163, filed on Jun. 21, 2018, which is based upon and claims priority to Chinese Patent Application No. 201721426923.9, filed on Oct. 31, 2017, with a title "PIXEL CIRCUITS AND DISPLAY DEVICES", the entire contents of which are hereby incorporated by reference.

TECHNICAL FIELD

Exemplary embodiments of the present application relate to display technologies, and more particularly to pixel circuits and driving methods thereof, display devices.

BACKGROUND

The organic light-emitting display device is a display device using an organic light-emitting diode (OLED) as a light-emitting device with the characteristics of high contrast, thin thickness, wide viewing angle, fast response speed, low power consumption, etc., and is increasingly applied to various displaying and illuminating fields.

In an existing organic light-emitting display device, a plurality of pixel circuits may be generally included. A plurality of pixel circuits are generally supplied with a power voltage by the same power source. The power voltage can determine current flowing through a light-emitting diode (LED) in the pixel circuit.

However, in practical applications, when the power voltage is transmitted between a plurality of pixel circuits, an IR drop is inevitably generated, resulting in a difference in the actual power voltage of each pixel circuit, thereby causing a difference in the current flowing through each of the light-emitting diodes, and an uneven display brightness of the display device.

SUMMARY

The main purpose of the application is to provide pixel circuits and driving methods thereof, display devices, which are intended to solve the problem that in the existing display device, the display brightness of the display device is uneven due to the difference in the current flowing through the light-emitting diode caused by the power voltage drop.

To achieve the above purpose, an exemplary embodiment of the application provides a pixel circuit comprising: a first thin film transistor, a second thin film transistor, a third thin film transistor, a fourth thin film transistor, a fifth thin film transistor, a sixth thin film transistor, a seventh thin film transistor, a light-emitting diode, and a storage capacitance; a gate of the first thin film transistor is respectively connected to a source of the second thin film transistor and one end of the storage capacitance, and the other end of the storage capacitance is respectively connected to a drain of the third thin film transistor and a source of the fourth thin film transistor, a source of the third thin film transistor is connected to a data signal line, and a drain of the fourth thin film transistor is respectively connected to a drain of the fifth thin film transistor and a reference voltage signal line; a source of the first thin film transistor is connected to a drain of the sixth thin film transistor, and a source of the sixth thin film transistor is connected to a first power source; and a drain of the first thin film transistor is respectively connected to a drain of the second thin film transistor and a source of the seventh thin film transistor, and a drain of the seventh thin film transistor is respectively connected to a source of the fifth thin film transistor and an anode of the light-emitting diode, and a cathode of the light-emitting diode is connected to a second power source.

Optionally, the first power source is configured to supply a power voltage to the first thin film transistor; and a current flows into the second power source when the light-emitting diode emits light.

Optionally, the reference voltage signal line is used to provide a reference voltage, which is a negative voltage and is smaller than a voltage of the second power source, and the reference voltage is used for initializing the gate of the first thin film transistor, both ends of the storage capacitance and the anode of the light-emitting diode; and the data signal line is used to provide a data voltage.

Optionally, a gate of the second thin film transistor, a gate of the fourth thin film transistor and a gate of the fifth thin film transistor are connected to a first scanning line configured to provide a first scanning signal; and the first scanning signal is used to control the second thin film transistor, the fourth thin film transistor, and the fifth thin film transistor to be in an on-state or an off-state; a gate of the third thin film transistor is connected to the second scanning line configured to provide a second scanning signal, and the second scanning signal is used to control the third thin film transistor to be in an on-state or an off-state; a gate of the seventh thin film transistor is connected to a first emission control line configured to provide a first emission control signal, and the first emission control signal is used to control the seventh thin film transistor to be in an on-state or an off-state; and a gate of the sixth thin film transistor is connected to a second emission control line configured to provide a second emission control signal, and the second emission control signal is used to control the sixth thin film transistor to be in an on-state or an off-state.

Optionally, when the first scanning signal controls the second thin film transistor and the fifth thin film transistor to be in an on-state, and the first emission control signal controls the seventh thin film transistor to be in an on-state, the reference voltage initializes the gate of the first thin film transistor and the end of the storage capacitance.

Optionally, when the first scanning signal controls the second thin film transistor and the fifth thin film transistor to be in an on-state, and the second emission control signal controls the sixth thin film transistor to be in an on-state, compensation is performed for a threshold voltage of the first thin film transistor.

Optionally, when the first scanning signal controls the fourth thin film transistor to be in an on-state, and the reference voltage signal line is connected to the other end of the storage capacitance, the reference voltage initializes the other end of the storage capacitance.

Optionally, when the first scanning signal controls the fifth thin film transistor to be in an on-state, and the reference voltage signal line is connected to the anode of the light-emitting diode, the reference voltage initializes the anode of the light-emitting diode.

Optionally, when the second scanning signal controls the third thin film transistor to be in an on-state, and the data signal line is connected to the other end of the storage capacitance, and applies a data voltage to the other end of the storage capacitance.

Optionally, when the first emission control signal controls the seventh thin film transistor to be in an on-state and the second emission control signal controls the sixth thin film transistor to be in an on-state, the first power source is connected to the source of the first thin film transistor through the sixth thin film transistor, the drain of the first thin film transistor is connected to the anode of the light-emitting diode through the seventh thin film transistor, a current independent of a power voltage provided by the first power source flows through the light-emitting diode.

Optionally, the first thin film transistor is a driving thin film transistor and the first thin film transistor is a P-type thin film transistor; and the second thin film transistor, the third thin film transistor, the fourth thin film transistor, the fifth thin film transistor, the sixth thin film transistor, and the seventh thin film transistor are independent P-type thin film transistors or N-type thin film transistors.

An exemplary embodiment of the application provides a method for driving the pixel circuit mentioned above, comprising: in a first stage, controlling by a first scanning signal the second thin film transistor, the fourth thin film transistor, and the fifth thin film transistor to change from an off-state to an on-state, controlling by a second scanning signal the third thin film transistor to be in an off-state; controlling by a first emission control signal the seventh thin film transistor to be in an on-state; initializing by a reference voltage a gate of the first thin film transistor, both ends of the storage capacitance, and an anode of the light-emitting diode; and controlling by a second emission control signal the sixth thin film transistor to change from an on-state to an off-state; in a second stage, controlling by the first scanning signal the second thin film transistor, the fourth thin film transistor, and the fifth thin film transistor to be in an on-state; controlling by the second scanning signal the third thin film transistor to be in an off-state; controlling by the first emission control signal the seventh thin film transistor to change from an on-state to an off-state, controlling by the second emission control signal the sixth thin film transistor to change from an off-state to an on-state, and compensating a threshold voltage of the first thin film transistor; in a third stage, controlling by the first scanning signal the second thin film transistor, the fourth thin film transistor, and the fifth thin film transistor to change from an on-state to an off-state; controlling by the second scanning signal the third thin film transistor to change from an off-state to an on-state; applying a data voltage to the other end of the storage capacitance; controlling by the first emission control signal the seventh thin film transistor to be in an off-state, and controlling by the second emission control signal the sixth thin film transistor to change from an on-state to an off-state; and in a fourth stage, controlling by the first scanning signal the second thin film transistor, the fourth thin film transistor, and the fifth thin film transistor to be in an off-state, controlling by the second scanning signal the third thin film transistor to change from an on-state to an off-state; controlling by the first emission control signal the seventh thin film transistor to change from an off-state to an on-state, controlling by the second emission control signal the sixth thin film transistor to change from an off-state to an on-state, and emitting light by the light-emitting diode.

Optionally, in the first stage, both a voltage across the storage capacitance and a gate voltage of the first thin film transistor are Vref, and Vref is the reference voltage.

Optionally, in the second stage, a gate of the first thin film transistor is connected to a drain of the first thin film transistor, and the first power source applies a voltage to a source of the first thin film transistor, such that a gate voltage of the first thin film transistor is VDD−Vth, and the threshold voltage of the first thin film transistor is compensated; wherein Vth is the threshold voltage of the first thin film transistor, and VDD is a power voltage provided by the first power source.

Optionally, in the third stage, the voltage of the other end of the storage capacitance changes from Vref to Vdata, and a gate voltage of the first thin film transistor is VDD−Vth+Vdata−Vref under an action of the storage capacitance, Vdata is the data voltage; and in the fourth stage, the current flowing through the light-emitting diode is independent of the power voltage provided by the first power source.

An exemplary embodiment of the application also provides a display device, including the pixel circuit recorded above.

The following beneficial effects can be achieved by at least one of the above technical solutions adopted by exemplary embodiments of the application:

The pixel circuit provided by an embodiment of the application includes seven thin film transistors, a storage capacitance, and a light-emitting diode. The pixel circuit can compensate the power voltage during the light-emitting stage of the light-emitting diode, so that the current flowing through the LED is related to the data voltage and the reference voltage input into the pixel circuit, and is independent of the power voltage, thereby effectively avoiding the problem of different current flowing through the LED caused by the power voltage drop and the display unevenness of the display device.

In addition, pixel circuits provided by exemplary embodiments of the application can further compensate the threshold voltage of the driving thin film transistor, thus the problem that the display unevenness of the display device due to the difference in threshold voltage of the driving thin film transistor can be effectively avoided.

DETAILED DESCRIPTION

In the pixel circuits provided by exemplary embodiments of the application, the first thin film transistor is a driving thin film transistor, specifically, a P-type thin film transistor; the second thin film transistor, the third thin film transistor, the fourth thin film transistor, the fifth thin film transistor, the sixth thin film transistor, and the seventh thin film transistor may all be P-type thin film transistors or may all be N-type thin film transistors, or at least one of these transistors is a P-type thin film transistor, and the rest of them are N-type thin film transistors, which is not specifically limited in exemplary embodiments of the application.

In exemplary embodiments of the application, for different types of thin film transistors, scanning signals provided by different scanning lines may be different. In exemplary embodiments of the application, it will be illustrated by taking the first thin film transistor to the seventh thin film transistor being P-type thin film transistors as an example.

The light-emitting diode may be an LED or an OLED, and is not specifically limited herein. The exemplary embodiments of the application will be illustrated by taking the light-emitting diode being an OLED for example.

The technical solutions provided by exemplary embodiments of the application will be described in detail below with reference to the accompanying drawings.

Figure 1:
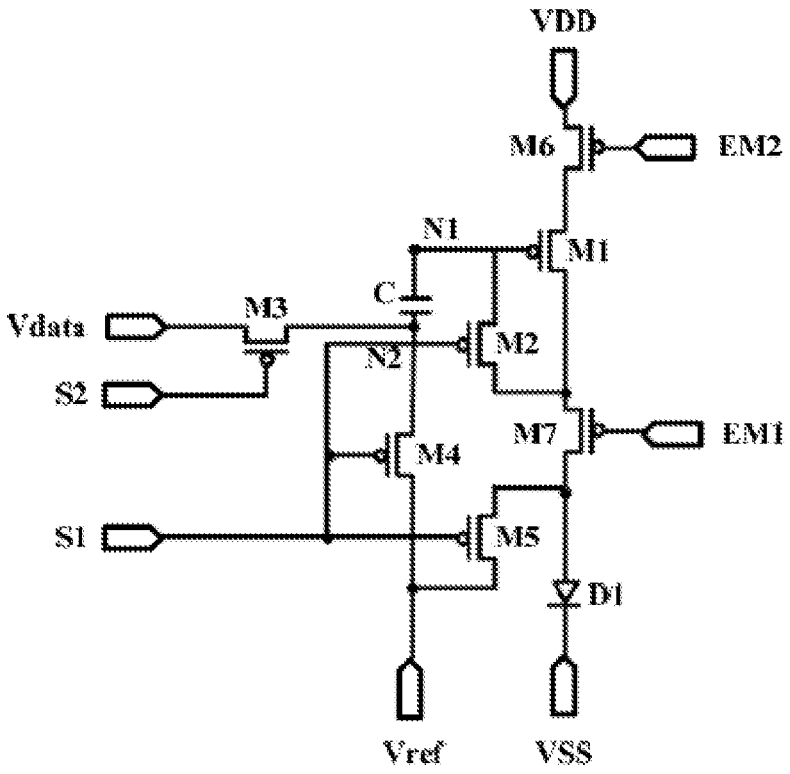
FIG. 1 is a schematic structural view of a pixel circuit according to an embodiment of the application.

FIG. 1 is a schematic structural view of a pixel circuit according to an embodiment of the application. The pixel circuit is as follows.

As shown in FIG. 1, the pixel circuit includes a first thin film transistor M1, a second thin film transistor M2, a third thin film transistor M3, a fourth thin film transistor M4, a fifth thin film transistor M5, a sixth thin film transistor M6, and a seventh thin film transistor M7, a storage capacitance C and a light-emitting diode (LED) D1. In the pixel circuit shown in FIG. 1, the first thin film transistor M1, the second thin film transistor M2, the third thin film transistor M3, the fourth thin film transistor M4, the fifth thin film transistor M5, the sixth thin film transistor M6, and the seventh thin film transistor M7 are all P-type thin film transistors, and the light-emitting diode D1 is an OLED.

The circuit connection structure of the pixel circuit shown in FIG. 1 is as follows: a gate of the first thin film transistor M1 is respectively connected to a source of the second thin film transistor M2 and one end of the storage capacitance C (point N1 shown in FIG. 1), a source of the first thin film transistor M1 is connected to a drain of the sixth thin film transistor M6, and a drain of the first thin film transistor M1 is respectively connected to a drain of the second thin film transistor M2 and a source of the seventh thin film transistor M7; a source of the third thin film transistor M3 is connected to a data signal line, a drain of the third thin film transistor M3 is respectively connected to a source of the fourth thin film transistor M4 and the other end of the storage capacitance C (point N2 shown in FIG. 1); a drain of the fourth thin film transistor M4 is respectively connected to a drain of the fifth thin film transistor M5 and a reference voltage signal line; a source of the fifth thin film transistor M5 is connected to a drain of the seventh thin film transistor M7 and an anode of the LED D1; a source of the sixth thin film transistor M6 is connected a first power source; and a cathode of the LED D1 is connected to a second power source.

In an embodiment of the application, the power voltage VDD provided by the first power source may be a positive voltage, and is used to supply a power voltage to the first thin film transistor M1. The first thin film transistor M1 may output the current under the action of the power voltage VDD provided by the first power source. The current flows into the LED D1 causing the LED D1 to emit light. When the LED D1 emits light, the current flows into the second power source. The power voltage VSS provided by the second power source may be a negative voltage.

The data signal line can be used to provide a data voltage Vdata. The reference voltage signal line can be used to provide a reference voltage Vref. In exemplary embodiments of the application, the reference voltage Vref may be a negative voltage, and be used to initialize the gate of the first thin film transistor M1, both ends of the storage capacitance C (point N1 and N2 in FIG. 2, i.e., the upper and lower electrode plate of the storage capacitance C) and the anode of the LED D1.

It should be noted that the reference voltage Vref may be a negative voltage lower than the power voltage VSS provided by the second power source, such that the reference voltage Vref may cause the LED D1 not to emit light when the anode of the LED D1 is initialized, thereby causing the display of the pixel to be pure black and improving the display contrast of the display device.

In the pixel circuit shown in FIG. 1, S1 is a first scanning signal provided by the first scanning line, S2 is a second scanning signal provided by the second scanning line, and EM1 is a first emission control signal provided by a first emission control line, EM2 is a second emission control signal provided by a second emission control line, a gate of the second thin film transistor M2, a gate of the fourth thin film transistor M4 and a gate of the fifth thin film transistor M5 are connected to the first scanning line; the first scanning signal S1 provided by the first scanning line can control the gate of the second thin film transistor M2, the gate of the fourth thin film transistor M4, and the gate of the fifth thin film transistor M5 to be in an on-state or an off-state; a gate of the third thin film transistor M3 is connected to the second scanning line, and the second scanning signal S2 provided by the second scanning line can control the third thin film transistor M3 to be in an on-state or an off-state; a gate of the seventh thin film transistor M7 is connected to the first emission control line, and the first emission control signal EM1 provided by the first emission control line can control the seventh thin film transistor M7 to be in an on-state or an off-state; a gate of the sixth thin film transistor M6 is connected to the second emission control line, and the second emission control signal EM2 provided by the second emission control line can control the sixth thin film transistor M6 to be in an on-state or an off-state.

In an embodiment of the application, the first scanning signal S1 can control the second thin film transistor M2, the fourth thin film transistor M4 and the fifth thin film transistor M5 to be in an on-state or an-off state simultaneously, when the first scanning signal S1 controls the second thin film transistor M2 and the fifth thin film transistor M5 to be in an on-state, the gate of the first thin film transistor M1 is connected to the drain of the first thin film transistor M1. At this time, if the seventh thin film transistor M7 is in an on-state, the reference voltage signal line is connected to the gate and the drain of the first thin film transistor M1, and one end of the storage capacitance C (point N1 shown in FIG. 1, i.e., the upper electrode plate of the storage capacitance C), and the reference voltage Vref initializes the gate and the drain of the first thin film transistor M1 and the upper electrode plate of the storage capacitance C; if the sixth thin film transistor M6 is in an on-state, the first power source applies the voltage to the source of the first thin film transistor M1 and charges the gate of the first thin film transistor M1, so that finally the gate voltage and the drain voltage of the first thin film transistor M1 can be changed into Vdata-Vth, and the compensation of a threshold voltage of the first thin film transistor M1 can be achieved when the LED D1 emits light; when the first scanning signal S1 controls the fifth thin film transistor M5 to be in an on-state, the reference voltage signal line can further be connected to the anode of the LED D1 through the fifth thin film transistor M5, and the reference voltage Vref initializes the anode of the LED D1; when the first scanning signal S1 controls the fourth thin film transistor M4 to be in an on-state, the reference voltage signal line is connected to the other end of the storage capacitance C (point N2 shown in FIG. 1, i.e., the lower electrode plate of the storage capacitance C) through the fourth thin film transistor M4, and the reference voltage Vref initializes the lower electrode plate of the storage capacitance C.

When the second scanning signal S2 controls the third thin film transistor M3 to be in an on-state, the data signal line applies a voltage to the other end of the storage capacitance C (point N2 shown in FIG. 1, i.e., the lower electrode plate of the storage capacitance C) through the third thin film transistor M3, thus the voltage of the lower electrode plate of the storage capacitance C is Vdata.

When the first emission control signal EM1 controls the seventh thin film transistor M7 to be in an on-state and the second emission control signal EM2 controls the sixth thin film transistor M6 to be in an on-state, the first power source is connected to the source of the first thin film transistor M1 through the sixth thin film transistor M6, and applies a voltage to the source of the first thin film transistor M1. The drain of the first thin film transistor M1 is connected to the anode of the LED D1 through the seventh thin film transistor M7. At this time, a driving current can be generated by the first thin film transistor M1 under the action of the power voltage VDD provided by the first power source, and the driving current flows into the LED D1 such that the LED D1 emits light.

The pixel circuit provided by an embodiment of the application can compensate the power voltage VDD provided by the first power source during the operation thereof, so that the current flowing through the LED D1 is independent of the power voltage provided by the first power source, thereby effectively avoiding the problem of the uneven display brightness of the display device due to the difference in the current flowing through the light-emitting diode caused by the power voltage drop. For a specific process of compensating the power voltage VDD provided by the first power source, reference may be made to the following description of the working principle of the pixel circuit.

Figure 2:
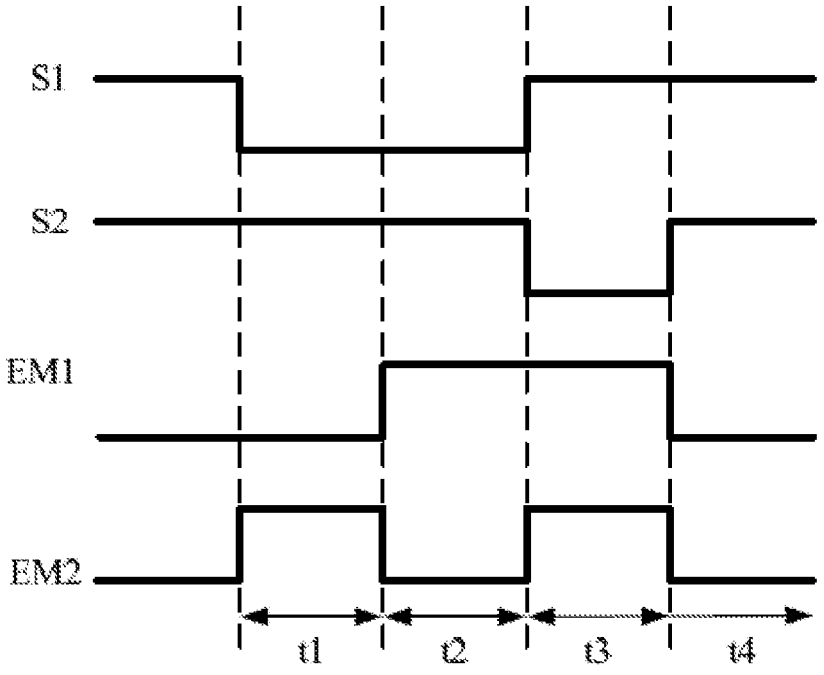
FIG. 2 is a timing view of a driving method for a pixel circuit according to an embodiment of the application.

FIG. 2 is a timing view of a driving method of a pixel circuit according to an embodiment of the application. The timing view in FIG. 2 may be used to drive the pixel circuit shown in FIG. 1. Specifically, when the timing view shown in FIG. 2 is used to drive the pixel circuit shown in FIG. 1, the duty cycle may include four stages: a first stage t1, a second stage t2, a third stage t3 and a fourth stage t4. The four stages of the pixel circuit will be explained separately in the following.

For the first stage t1, since the first scanning signal S1 changes from a high level to a low level, the second scanning signal S2 maintains a high level, the first emission control signal EM1 maintains a low level, the second emission control signal EM2 changes from a low level to a high level, thus the second thin film transistor M2, the fourth thin film transistor M4 and the fifth thin film transistor M5 are in an on-state, the third thin film transistor M3 is in an off-state, the seventh thin film transistor M7 is in an on-state, and the sixth thin film transistor M6 changes from an on-state to an off-state.

At this time, for the storage capacitance C, the reference voltage signal line is connected to the lower electrode plate of the storage capacitance C (point N2 shown in FIG. 1) through the fourth thin film transistor M4, and the reference voltage Vref applies a voltage to the lower electrode plate of the storage capacitance C, so that the voltage of the lower electrode plate of the storage capacitance C is Vref, thereby realizing initialization of the lower electrode plate of the storage capacitance C.

For the LED D1, the reference voltage signal line is connected to the anode of the LED D1 through the fifth thin film transistor M5, and applies a reference voltage Vref to the anode of the LED D1 to realize initialization of the anode of the LED D1. At this time, since the reference voltage Vref may be a negative voltage lower than the power voltage VSS provided by the second power source, the LED D1 does not emit light, and thus the pixel circuit can display pure black, thereby improving the display contrast of the display device.

For the first thin film transistor M1, the drain of the first thin film transistor M1 is connected to the gate of the first thin film transistor through the second thin film transistor M2, the reference voltage signal line is connected to the gate and the drain of the first thin film transistor M1 and the upper electrode plate of the storage capacitance C (N1 shown in FIG. 1) through the fifth thin film transistor M5 and the seventh thin film transistor M7. The reference voltage signal line applies a reference voltage Vref to the gate and drain of the first thin film transistor M1 and the upper electrode plate of the storage capacitance C, so that the gate voltage and the drain voltage of the first thin film transistor M1 and the voltage of the upper electrode plate of the storage capacitance C are all Vref, thereby realizing initialization of the gate and the drain of the first thin film transistor M1 and the upper electrode plate of the storage capacitance C.

After the end of the first stage t1, the gate voltage and the drain voltage of the first thin film transistor M1 are both Vref. The voltage of the upper electrode plate of the storage capacitance C is Vref, and the voltage of the lower electrode plate of the storage capacitance C is Vref.

For the second stage t2, since the first scanning signal S1 maintains a low level, the second scanning signal S2 maintains a high level, and the first emission control signal EM1 changes from a low level to a high level, the second emission control signal EM2 changes from a high level to a low level, thus the second thin film transistor M2, the fourth thin film transistor M4 and the fifth thin film transistor M5 are in an on-state, the third thin film transistor M3 is in an off-state, the seventh thin film transistor M7 changes from an on-state to an off-state, and the sixth thin film transistor M6 changes from an off-state to an on-state.

At this time, the gate of the first thin film transistor M1 is still connected to the drain of the first thin film transistor M1. The first power source applies a voltage to the source of the first thin film transistor M1 through the sixth thin film transistor M6, and charges the gate of the first thin film transistor M1 through the drain of the first thin film transistor M1. After the circuit is stabilized, the gate voltage and the drain voltage of the first thin film transistor M1 are both VDD−Vth. Vth is a threshold voltage of the first thin film transistor M1, so that the threshold voltage of the first thin film transistor M1 can be compensated when the LED D1 emits light.

In the second stage t2, the voltage of the lower electrode plate of the storage capacitance C keeps constant at Vref, and the voltage of the upper electrode plate of the storage capacitance C is equal to the gate voltage of the first thin film transistor M1, that is, VDD−Vth.

For the third stage t3, since the first scanning signal S1 changes from a low level to a high level, the second scanning signal S2 changes from a high level to a low level, and the first emission control signal EM1 maintains a high level, the second emission control signal EM2 changes from a low level to a high level, thus the second thin film transistor M2, the fourth thin film transistor M4 and the fifth thin film transistor M5 changes from an on-state to an off-state, the third thin film transistor M3 changes from an off-state to an on-state, the seventh thin film transistor M7 is in an off-state, and the sixth thin film transistor M6 changes from an on-state to an off-state.

At this time, the data signal line is connected to the lower electrode plate (point N2 shown in FIG. 1) of the storage capacitance C through the third thin film transistor M3, and applies a data voltage Vdata to the lower electrode plate of the storage capacitance C, so that the voltage of the lower electrode plate of the storage capacitance C changes from Vref to Vdata. Accordingly, the voltage of the upper electrode plate (point N1 shown in FIG. 1) of the storage capacitance C changes from VDD−Vth to VDD−Vth+

Vdata−Vref, that is, the gate voltage of the first thin film transistor M1 also changes from VDD−Vth to VDD−Vth+Vdata−Vref.

For the fourth stage t4, since the first scanning signal S1 maintains a high level, the second scanning signal S2 changes from a low level to a high level, and the first emission control signal EM1 changes from a high level to a low level, the second emission control signal EM2 changes from a high level to a low level, thus the second thin film transistor M2, the fourth thin film transistor M4 and the fifth thin film transistor M5 is in an off-state, the third thin film transistor M3 changes from an on-state to an off-state, the seventh thin film transistor M7 changes from an off-state to an on-state, and the sixth thin film transistor M6 changes from an off-state to an on-state.

At this time, the first power source applies a voltage to the source of the first thin film transistor M1 through the sixth thin film transistor M6. Under the action of the power voltage VDD provided by the first power source, the first thin film transistor M1 generates a driving current which flows into the LED D1 through the seventh thin film transistor M7, so that the LED D1 emits light. The current flowing through the LED D1 can be expressed as:

$$I_{OLED} = \mu C_{ox}\frac{W}{2L}(V_{sg} - Vth)^2 = \mu C_{ox}\frac{W}{2L}(V_g - V_s - Vth)^2 = \mu C_{ox}\frac{W}{2L}(Vref - Vdata)^2$$

Wherein, μ is a electron mobility of the first thin film transistor M1, $C_{ox}$ is a gate oxide layer capacitance per unit area of the first thin film transistor M1, W/L is a width to length ratio of the first thin film transistor M1, and $V_s$ is the source voltage VDD of the first thin film transistor M1, $V_g$ is the gate voltage VDD−Vth+Vdata−Vref of the first thin film transistor M1.

It can be seen from the above formula that the current flowing through the LED D1 is related to the reference voltage Vref and the data voltage Vdata, and is independent of the power voltage supplied by the first power source, and is also independent of the threshold voltage Vth of the first thin film transistor M1. The compensation for the power voltage VDD provided by the first power source can be achieved and the influence of the power voltage drop of the first power source on the display effect can be avoided, thereby ensuring the display evenness of the display device. Meanwhile, the compensation for the threshold voltage of the first thin film transistor M1 can be achieved, thereby avoiding the problem of display unevenness of the display device caused by a difference in threshold voltage of the first thin film transistor M1.

An exemplary embodiment of the application further provides a display device which may include the pixel circuit described above.

It will be apparent to a person skilled in the art that various modifications and variations can be made to the application without departing from the scope of the application. Thus, it is intended that the present application covers the modifications and variations as long as the modifications and variations made to the application belong to the protection scope of the appended claims and the equivalent technology thereof of the application.

What is claimed is:

1. A pixel circuit comprising:

a first thin film transistor, a second thin film transistor, a third thin film transistor, a fourth thin film transistor, a fifth thin film transistor, a sixth thin film transistor, a seventh thin film transistor, a light-emitting diode, and a storage capacitance;

wherein a gate of the first thin film transistor is respectively connected to a source of the second thin film transistor and one end of the storage capacitance, the other end of the storage capacitance is respectively connected to a drain of the third thin film transistor and a source of the fourth thin film transistor, a source of the third thin film transistor is connected to a data signal line, and a drain of the fourth thin film transistor is respectively connected to a drain of the fifth thin film transistor and a reference voltage signal line;

a source of the first thin film transistor is connected to a drain of the sixth thin film transistor, and a source of the sixth thin film transistor is connected to a first power source; and a drain of the first thin film transistor is respectively connected to a drain of the second thin film transistor and a source of the seventh thin film transistor, a drain of the seventh thin film transistor is respectively connected to a source of the fifth thin film transistor and an anode of the light-emitting diode, and a cathode of the light-emitting diode is connected to a second power source, wherein the reference voltage signal line is used to provide a reference voltage, which is a negative voltage and is smaller than a voltage of the second power source, and the reference voltage is used for initializing the gate of the first thin film transistor, both ends of the storage capacitance and the anode of the light-emitting diode; and the data signal line is used to provide a data voltage, wherein a gate of the second thin film transistor, a gate of the fourth thin film transistor and a gate of the fifth thin film transistor are connected to a first scanning line configured to provide a first scanning signal, and the first scanning signal is used to control the second thin film transistor, the fourth thin film transistor, and the fifth thin film transistor to be in an on-state or an off-state;

a gate of the third thin film transistor is connected to the second scanning line configured to provide a second scanning signal, and the second scanning signal is used to control the third thin film transistor to be in an on-state or an off-state;

a gate of the seventh thin film transistor is connected to a first emission control line configured to provide a first emission control signal, and the first emission control signal is used to control the seventh thin film transistor to be in an on-state or an off-state; and a gate of the sixth thin film transistor is connected to a second emission control line configured to provide a second emission control signal, and the second emission control signal is used to control the sixth thin film transistor to be in an on-state or an off-state.

2. The pixel circuit according to claim 1, wherein the first power source is configured to supply a power voltage to the first thin film transistor; and a current flows into the second power source when the light-emitting diode emits light.

3. The pixel circuit according to claim 1, wherein when the first scanning signal controls the second thin film transistor and the fifth thin film transistor to be in an on-state, and the first emission control signal controls the seventh thin film transistor to be in an on-state, the reference voltage initializes the gate of the first thin film transistor and the end of the storage capacitance.

4. The pixel circuit according to claim 1, wherein when the first scanning signal controls the second thin film transistor and the fifth thin film transistor to be in an on-state, and the second emission control signal controls the sixth thin film transistor to be in an on-state, compensation is performed for a threshold voltage of the first thin film transistor.

5. The pixel circuit according to claim 1, wherein when the first scanning signal controls the fourth thin film transistor to be in an on-state, and the reference voltage signal line is connected to the other end of the storage capacitance, the reference voltage initializes the other end of the storage capacitance.

6. The pixel circuit according to claim 1, wherein when the first scanning signal controls the fifth thin film transistor to be in an on-state, and the reference voltage signal line is connected to the anode of the light-emitting diode, the reference voltage initializes the anode of the light-emitting diode.

7. The pixel circuit according to claim 1 wherein when the second scanning signal controls the third thin film transistor to be in an on-state, and the data signal line is connected to the other end of the storage capacitance, and applies a data voltage to the other end of the storage capacitance.

8. The pixel circuit according to claim 1, wherein when the first emission control signal controls the seventh thin film transistor to be in an on-state and the second emission control signal controls the sixth thin film transistor to be in an on-state, the first power source is connected to the source of the first thin film transistor through the sixth thin film transistor, the drain of the first thin film transistor is connected to the anode of the light-emitting diode through the seventh thin film transistor, a current independent of a power voltage provided by the first power source flows through the light-emitting diode.

9. The pixel circuit according to claim 1, wherein the first thin film transistor is a driving thin film transistor and the first thin film transistor is a P-type thin film transistor; and the second thin film transistor, the third thin film transistor, the fourth thin film transistor, the fifth thin film transistor, the sixth thin film transistor, and the seventh thin film transistor are independent P-type thin film transistors or N-type thin film transistors.

10. A method for driving the pixel circuit according to claim 1, comprising:

in a first stage, controlling by a first scanning signal the second thin film transistor, the fourth thin film transistor, and the fifth thin film transistor to change from an off-state to an on-state, controlling by a second scanning signal the third thin film transistor to be in an off-state; controlling by a first emission control signal the seventh thin film transistor to be in an on-state; initializing by a reference voltage a gate of the first thin film transistor, both ends of the storage capacitance, and an anode of the light-emitting diode; and controlling by a second emission control signal the sixth thin film transistor to change from an on-state to an off-state;

in a second stage, controlling by the first scanning signal the second thin film transistor, the fourth thin film transistor, and the fifth thin film transistor to be in an on-state; controlling by the second scanning signal the third thin film transistor to be in an off-state; controlling by the first emission control signal the seventh thin film transistor to change from an on-state to an off-state, controlling by the second emission control signal the sixth thin film transistor to change from an off-state to an on-state, and compensating a threshold voltage of the first thin film transistor;

in a third stage, controlling by the first scanning signal the second thin film transistor, the fourth thin film transistor, and the fifth thin film transistor to change from an on-state to an off-state; controlling by the second scanning signal the third thin film transistor to change from an off-state to an on-state; applying a data voltage to the other end of the storage capacitance; controlling by the first emission control signal the seventh thin film transistor to be in an off-state, and controlling by the second emission control signal the sixth thin film transistor to change from an on-state to an off-state; and in a fourth stage, controlling by the first scanning signal the second thin film transistor, the fourth thin film transistor, and the fifth thin film transistor to be in an off-state, controlling by the second scanning signal the third thin film transistor to change from an on-state to an off-state; controlling by the first emission control signal the seventh thin film transistor to change from an off-state to an on-state, controlling by the second emission control signal the sixth thin film transistor to change from an off-state to an on-state, and emitting light by the light-emitting diode.

11. The driving method according to claim 10, wherein in the first stage, both a voltage across the storage capacitance and a gate voltage of the first thin film transistor are Vref, and Vref is the reference voltage.

12. The driving method according to claim 10, wherein in the second stage, a gate of the first thin film transistor is connected to a drain of the first thin film transistor, and the first power source applies a voltage to a source of the first thin film transistor, such that a gate voltage of the first thin film transistor is VDD−Vth, and the threshold voltage of the first thin film transistor is compensated; wherein Vth is the threshold voltage of the first thin film transistor, and VDD is a power voltage provided by the first power source.

13. The driving method according to claim 10, wherein in the third stage, the voltage of the other end of the storage capacitance changes from Vref to Vdata, and a gate voltage of the first thin film transistor is VDD−Vth+Vdata−Vref under an action of the storage capacitance, Vdata referring to the data voltage; and in the fourth stage, the current flowing through the light-emitting diode is independent of the power voltage provided by the first power source.

14. A display device, comprising the pixel circuit according to claim 1.

* * * * *